US006860756B2

(12) United States Patent
Chen

(10) Patent No.: US 6,860,756 B2
(45) Date of Patent: Mar. 1, 2005

(54) TERMINAL WITH A HEAT SHRINK COLLAR FOR WRAPPING CONNECTED WIRES

(75) Inventor: Joe Chen, Ta Li (TW)

(73) Assignee: UTA Auto Industrial Co., Ltd., Taichung (TW)

( * ) Notice: Subject to any disclaimer, the term of this patent is extended or adjusted under 35 U.S.C. 154(b) by 0 days.

(21) Appl. No.: 10/341,266

(22) Filed: Jan. 14, 2003

(65) Prior Publication Data

US 2004/0137787 A1 Jul. 15, 2004

(51) Int. Cl.[7] ..... H01R 13/52
(52) U.S. Cl. ..... 439/523; 439/932
(58) Field of Search ..... 439/523, 730, 439/932

(56) References Cited

U.S. PATENT DOCUMENTS 3,601,783 A * 8/1971 Loose ..... 439/730
6,454,598 B1 * 9/2002 Burwell et al. ..... 439/523

* cited by examiner

*Primary Examiner*—Gary Paumen
(74) *Attorney, Agent, or Firm*—Rosenberg, Klein & Lee

(57) ABSTRACT

A terminal with a heat shrink tube for wrapping connected wires includes a metal sleeve being made of copper and having an enlarged portion formed on one end of the metal sleeve. The metal sleeve receives at least one stripped litz wire and is securely electrically connected to the at least one stripped litz wire after being clamped. A plastic collar is longitudinally connected to the enlarged portion of the metal sleeve. The plastic collar is a heat shrink tube and has a tapered portion formed on one end of the plastic collar. The tapered portion is connected to the enlarged portion of the metal sleeve such that a diameter of the tapered portion is gradually reduced relative to the metal and adapted for guiding the at least one stripped litz wire into the metal sleeve.

4 Claims, 7 Drawing Sheets

TERMINAL WITH A HEAT SHRINK COLLAR FOR WRAPPING CONNECTED WIRES

BACKGROUND OF THE INVENTION

1. Field of the Invention

The present invention relates to a terminal, and more particularly to a terminal with a heat shrink tube for wrapping connected wires.

2. Description of Related Art

A conventional terminal in accordance with the prior art shown in FIG. 10 comprises metal sleeve (62) and a plastic collar (61) longitudinally connected to the one end of the metal sleeve (62). The metal sleeve (62) is provided to receive a stripped litz wire and clamped such that the stripped litz wire is securely received in the metal sleeve (62) and electrically connected with the metal sleeve (62). The plastic collar (61) is insulated and provide for user to hold the terminal and insert the metal sleeve (62) into an electric device (not shown).

However, the metal sleeve (62) has a small diameter such that the metal sleeve (62) of the conventional terminal can only receive a litz wire and the plastic collar (61) is made of hard material such that the plastic collar (61) is separated relative to the litz wire such that the insulating effect of the plastic collar (61) is reduced.

Consequently, a second embodiment of the conventional terminal is marketed. With reference to FIG. 11, the second conventional terminal comprises a metal sleeve (72) having a diameter greater than that of the metal sleeve (62) of the first conventional for receiving two litz wires in the metal sleeve (72). A plastic collar (71) is longitudinally connected to the metal sleeve (72). The metal sleeve (72) has a round inner section and the plastic collar (71) has an approximately oval or rectangular inner section. With reference to FIG. 12, the second conventional terminal is hard to be inserted into the electric device (8) when the sockets (not numbered) of the electric device is closed to one another because the plastic collar (71) has a oval or rectangular inner section. Furthermore, the plastic collar (71) of the second embodiment of the conventional terminal is made of hard material such that the disadvantage of the first embodiment of the conventional terminal still has not been solved for providing a good insulating effect.

The present invention has arisen to mitigate and/or obviate the disadvantages of the conventional terminals.

SUMMARY OF THE INVENTION

The main objective of the present invention is to provide an improved terminal with a heat shrink tube for wrapping connected wires.

To achieve the objective, the terminal in accordance with the present invention comprises a metal sleeve being made of copper and having an enlarged portion formed on one end of the metal sleeve. The metal sleeve receives at least one stripped litz wire and is securely electrically connected to the at least one stripped litz wire after being clamped. A plastic collar is longitudinally connected to the enlarged portion of the metal sleeve. The plastic collar is a heat shrink tube and has a tapered portion formed on one end of the plastic collar. The tapered portion is connected to the enlarged portion of the metal sleeve such that a diameter of the tapered portion is gradually reduced relative to the metal and adapted for guiding the at least one stripped litz wire into the metal sleeve.

Further benefits and advantages of the present invention will become apparent after a careful reading of the detailed description with appropriate reference to the accompanying drawings.

DETAILED DESCRIPTION OF THE INVENTION

Figure 1:
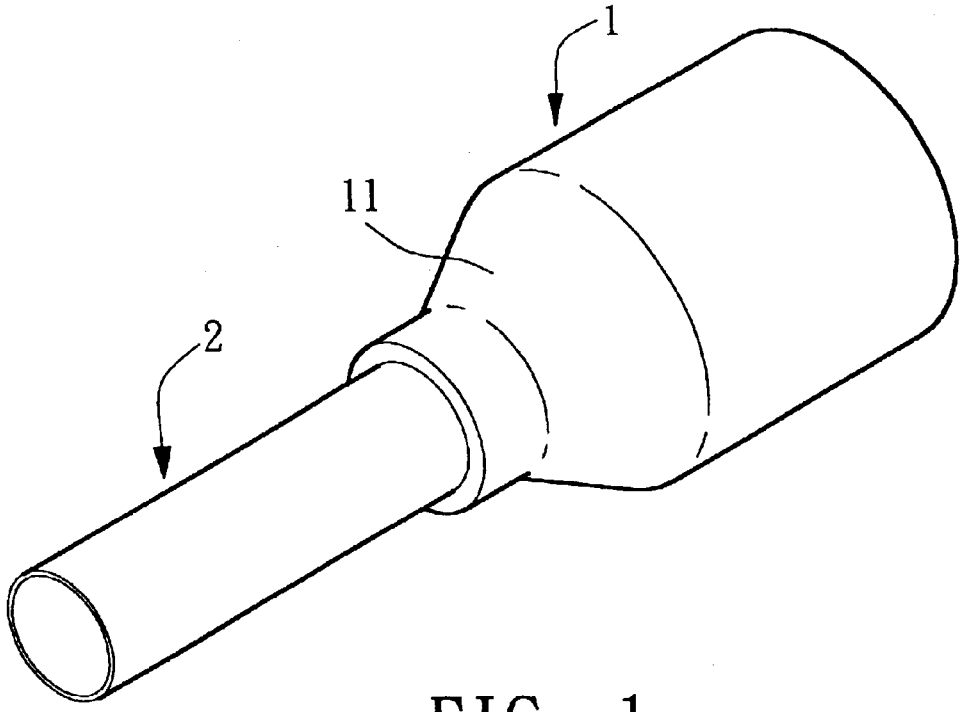
FIG. 1 is a perspective view of a terminal with a heat shrink collar for wrapping connected wires in accordance with the present invention.
Figure 2:
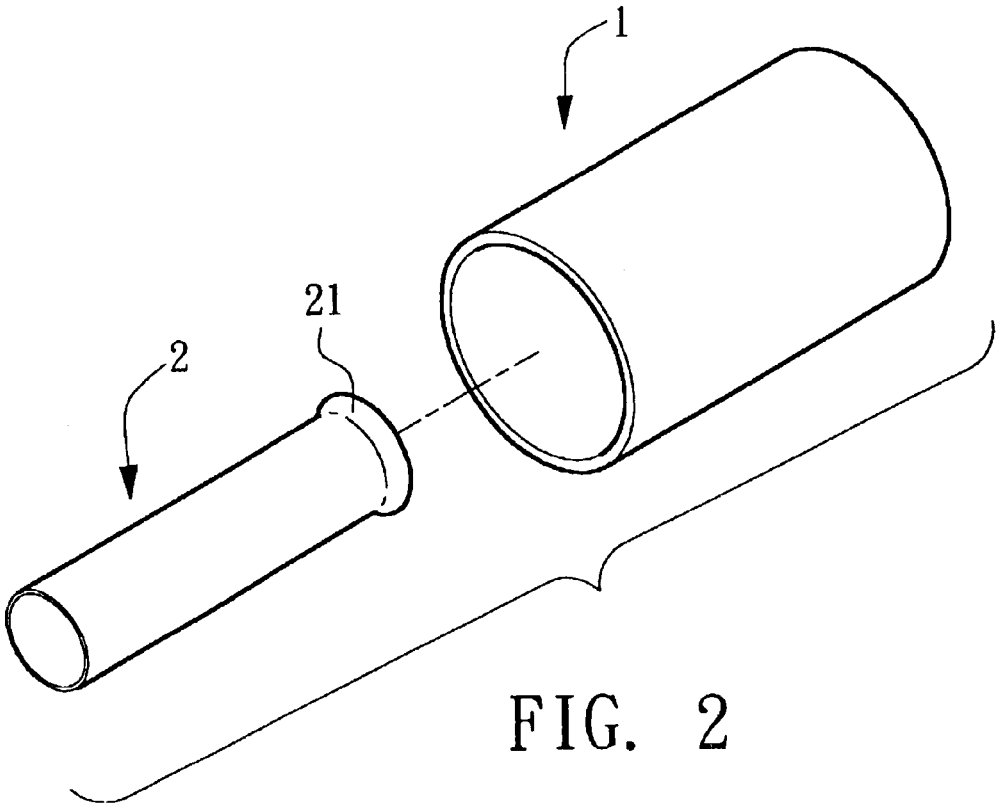
FIG. 2 is an exploded perspective view of the terminal in FIG. 1.
Figure 3:
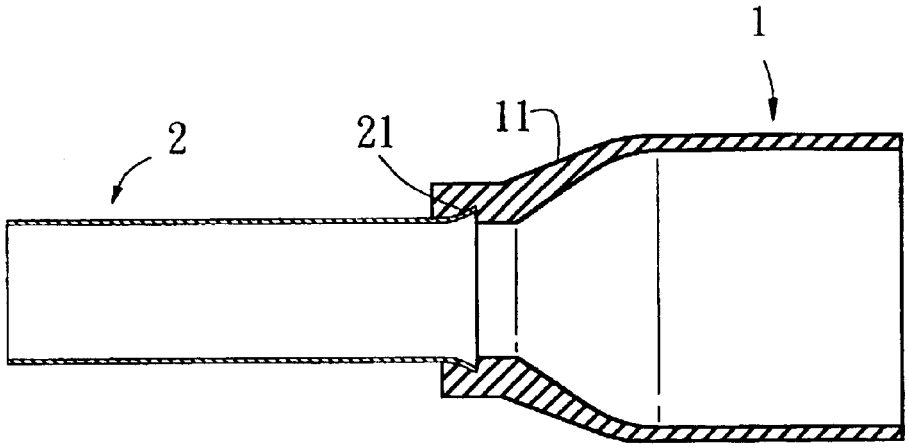
FIG. 3 is a side cross sectional view of the terminal in FIG. 1.

Referring to the drawings and initially to FIGS. 1–3, a terminal with a heat shrink collar for wrapping connected wires in accordance with the present invention comprises a metal sleeve (2) and plastic collar (1) longitudinally connected to the metal sleeve (2).

The metal sleeve (2) is made of copper and has an enlarged portion (21) formed on one end of the metal sleeve (2). The metal sleeve (2) is provided to receive at least one stripped litz wire and securely electrically connected to the litz wire after being clamped.

The plastic collar (1) is a heat shrink tube and has a tapered portion (11) formed on one end of the plastic collar (1). The tapered portion (11) is connected to the enlarged portion (21) of the metal sleeve (2) such that the diameter of the tapered portion (11) is gradually reduced relative to the metal sleeve (1) for guiding the stripped litz wire into the metal sleeve (2).

Figure 4:
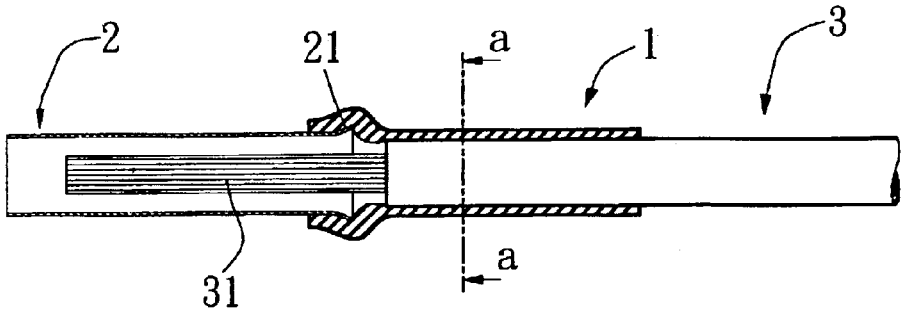
FIG. 4 is a side schematic view in cross section of the terminal in FIG. 1.
Figure 4A:
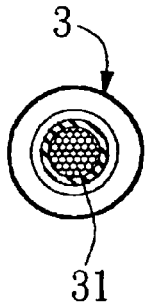
FIG. 4*a* is a rear cross sectional view of the terminal along line a—a in FIG. 4.
Figure 5:
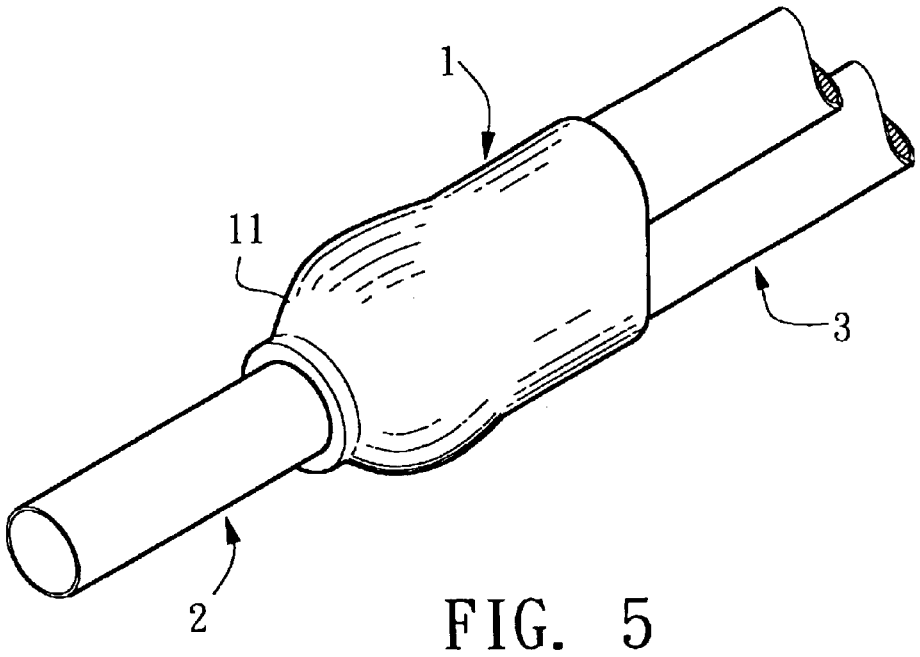
FIG. 5 is a perspective schematic view of a second embodiment of the terminal in accordance with the present invention.
Figure 6:
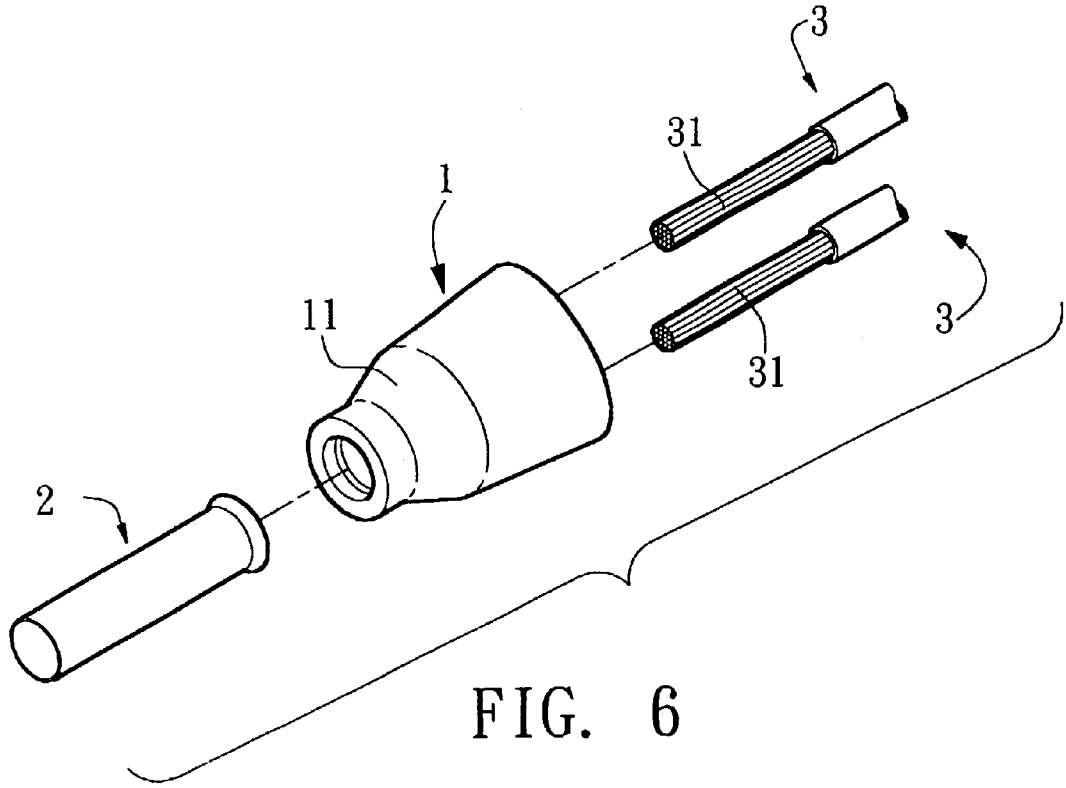
FIG. 6 is an exploded perspective view of the terminal in FIG. 5.
Figure 7:
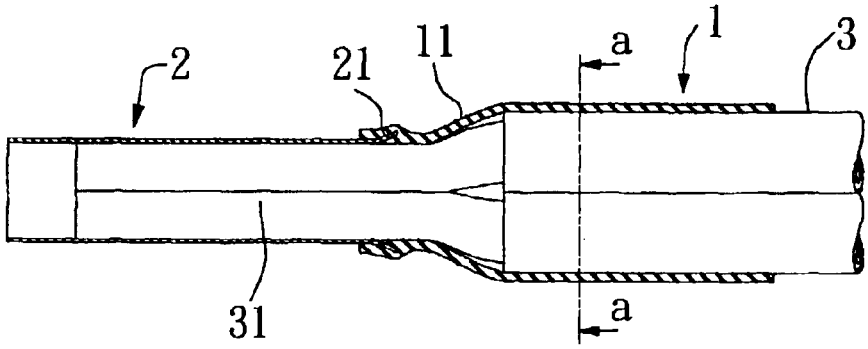
FIG. 7 is a side schematic view in cross section of the terminal in FIG. 5.
Figure 7A:
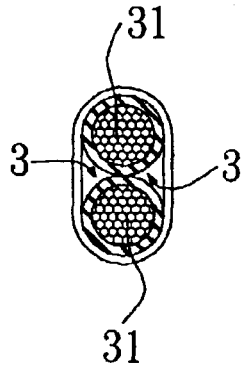
FIG. 7*a* is a rear cross-sectional view of the terminal along line a—a in FIG. 7.
Figure 8:
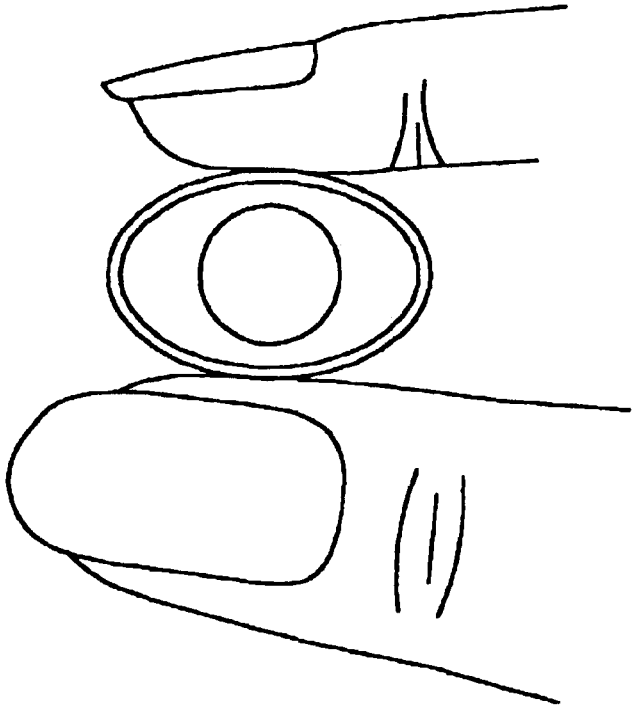
FIG. 8 is a top plan view of the terminal when the plastic collar is pressed and transformed as an oval shape.
Figure 9:
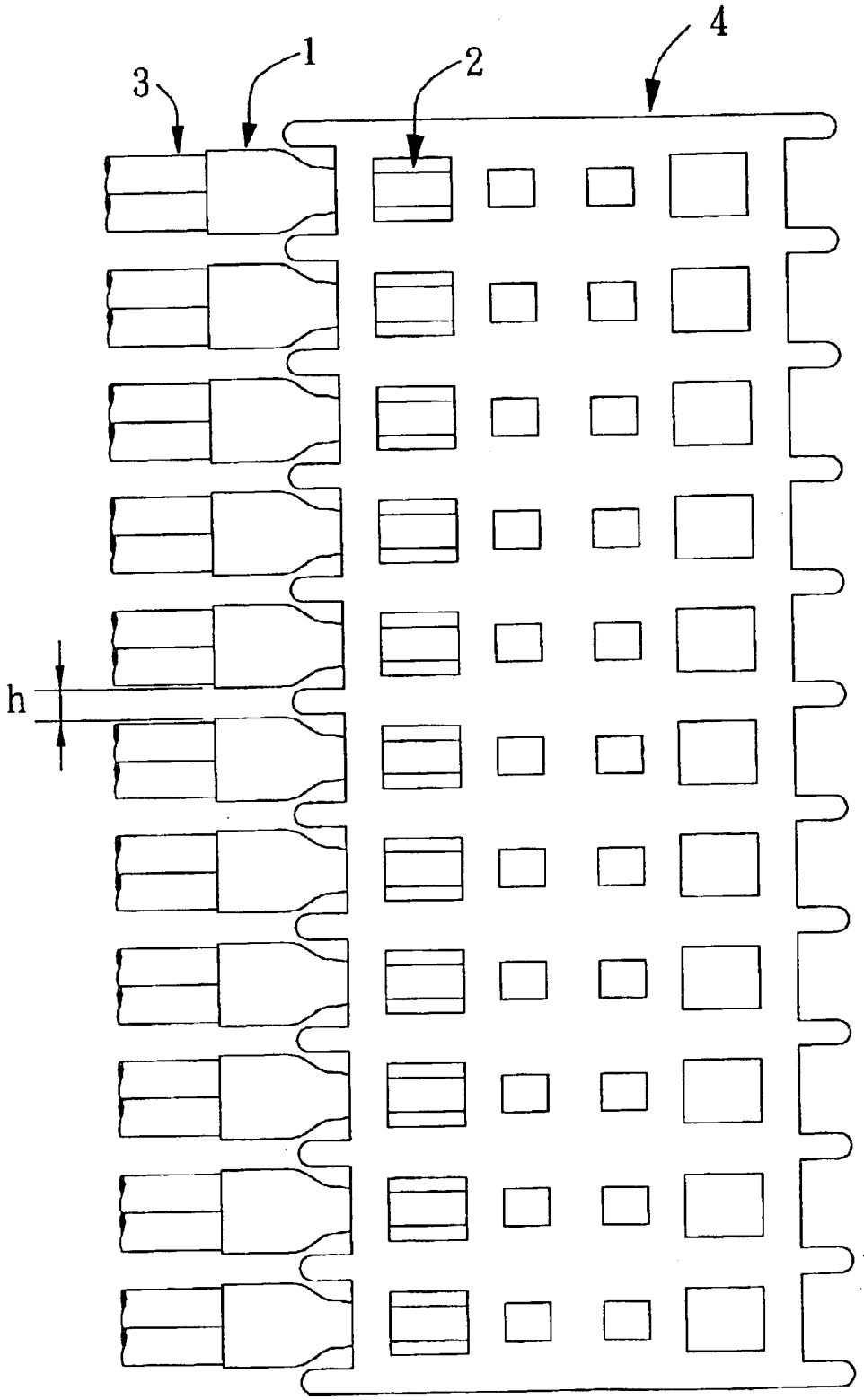
FIG. 9 is a plan schematic view of the second embodiment of the terminal in FIG. 5, wherein the terminals are inserted into an electric device.
Figure 10:
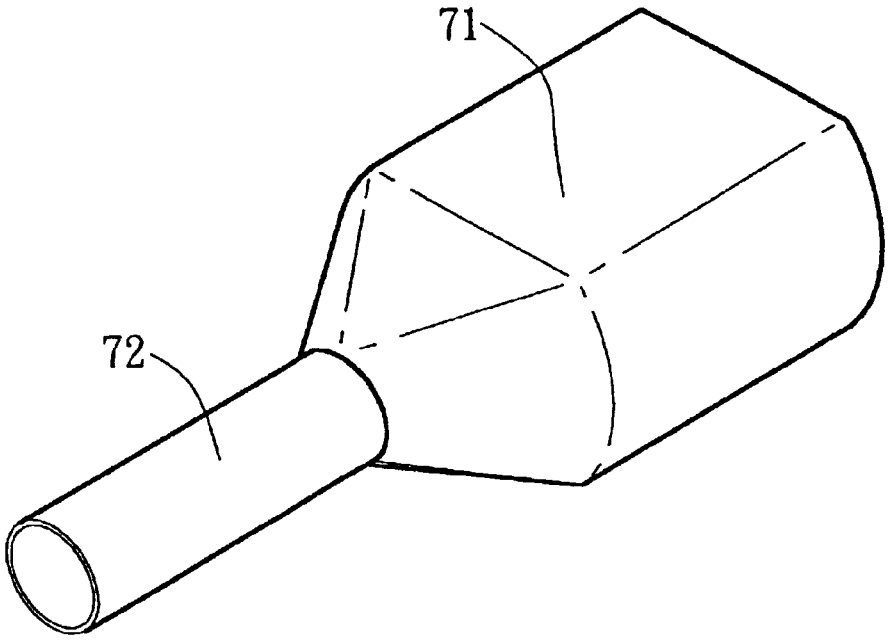
FIG. 10 PRIOR ART
FIG. 10 is perspective view of a first conventional terminal in accordance with the prior art.
Figure 11:
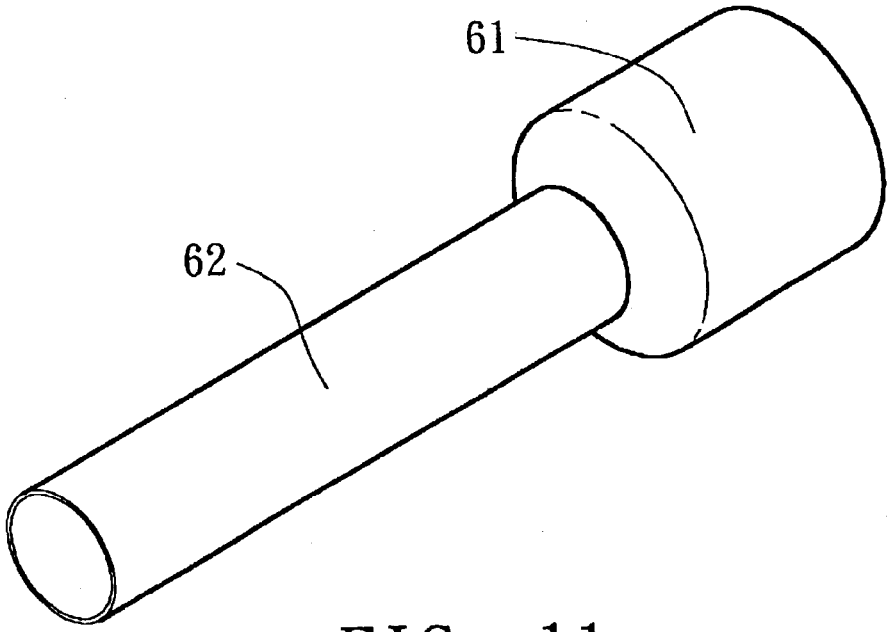
FIG. 11 PRIOR ART
FIG. 11 is a perspective view of a second conventional terminal in accordance with the prior art.
Figure 12:
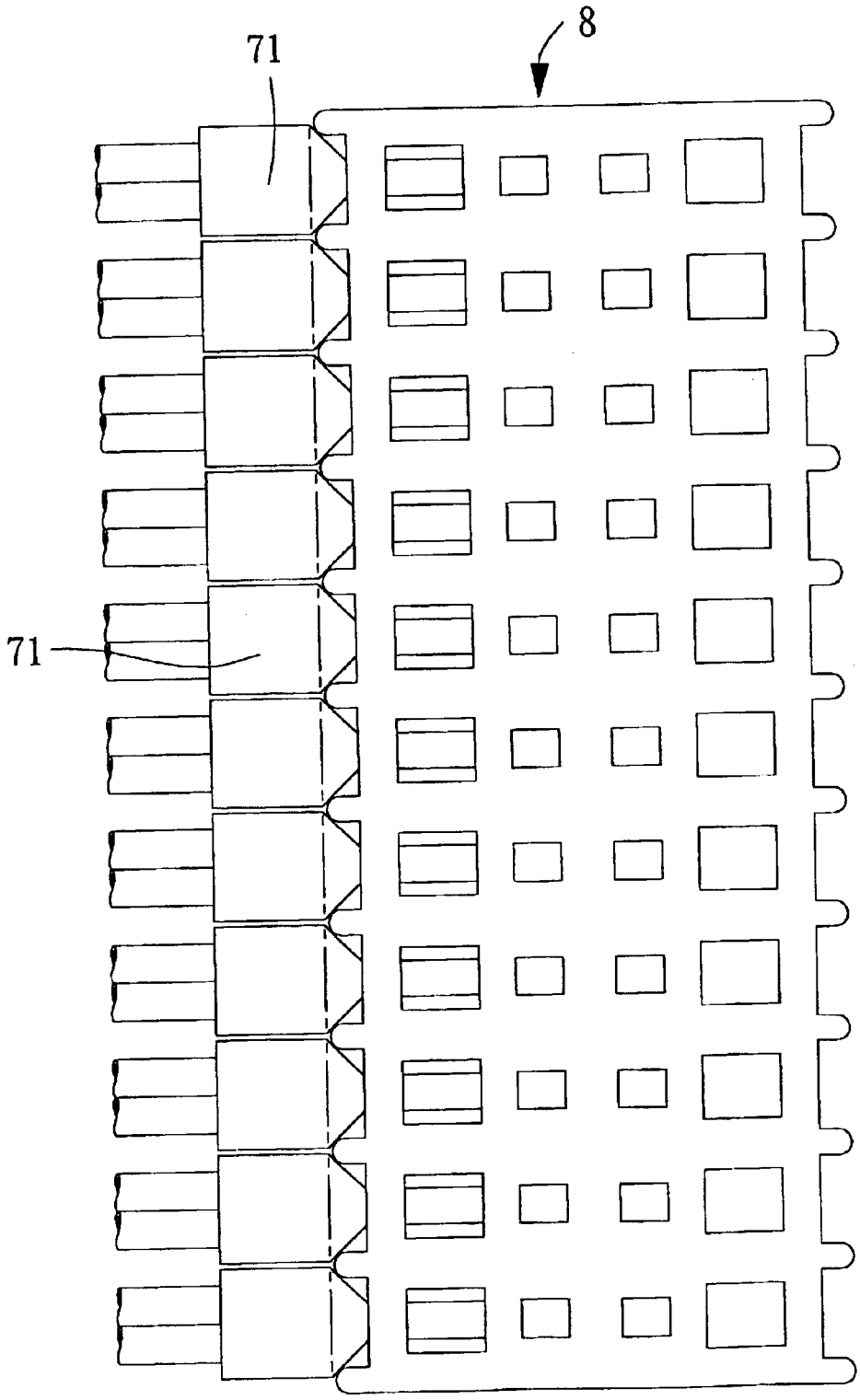
FIG. 12 PRIOR ART
FIG. 12 is a plan schematic view of the conventional terminal in FIG. 11, wherein the terminals are inserted into an electric device.

With reference to FIG. 4, in the preferred embodiment that the metal sleeve (1) receives a wire (3). The wire (3) has a front section (31) that is a stripped litz wire and is received in the metal sleeve (1). The metal sleeve (1) is clamped and securely connected with the front section (31) of the wire (3). The plastic collar (1) is heated and wraps the wire (3) after clamping the metal sleeve (2) because the plastic collar (1) is a heat shrink tube.

With reference to FIGS. 5–8, it is another embodiment of the terminal in accordance with the present invention. The metal sleeve (20) is clamped when the two stripped litz wires (31) is received in the metal sleeve (20) and then, the plastic collar (1) is heated to wrap the two wires (3). The user can press the plastic collar (1) to transform the shape of the plastic collar (1) as an oval that has a major axis longer than the total width of the two wires (3) for easily receiving two wires (3) at the same time because the heat shrink tube is flexible.

As described above, the collar (1) of the terminal in accordance with the present invention is heated and shrunk to wrap the connected wires (3) such that the insulating effect of the present invention is promoted. Furthermore, with reference to FIG. 8, the volume of the terminal of the present invention is narrowed after the plastic collar (1) being heated. Consequently, a distance (h) between two adjacent terminals is greater than that between the two adjacent conventional terminals when inserted into an electric device (4) such that the terminal in accordance with the present invention is easily operated.

Furthermore, there is heat-melted glue smeared on an inner periphery of the plastic collar (1) such that the plastic collar (1) wraps on the connected wires (3) and adhered on an outer periphery of the connected wires (3) to promote the connection between the wires (3) and the plastic collar (1).

Although the invention has been explained in relation to its preferred embodiment, it is to be understood that many other possible modifications and variations can be made without departing from the spirit and scope of the invention as hereinafter claimed.

What is claimed is:

1. A terminal with a heat shrink tube for wrapping connected wires, comprising:

a metal sleeve being made of copper and having an enlarged portion formed on one end of the metal sleeve, the metal sleeve adapted to receive at least one stripped litz wire of at least one wire and securely electrically connected to the at least one stripped litz wire after being clamped; and a plastic collar longitudinally connected to the enlarged portion of the metal sleeve, the plastic collar being a heat shrink tube and having a tapered portion formed on one end of the plastic collar, the tapered portion connected to the enlarged portion of the metal sleeve such that a diameter of the tapered portion is gradually reduced relative to the metal and adapted for guiding the at least one stripped litz wire into the metal sleeve.

2. The terminal as claimed in claim 1, wherein the metal sleeve is adapted to receive two stripped litz wires.

3. The terminal as claimed in claim 1, wherein the metal sleeve and the plastic collar each has a round inner section.

4. The terminal as claimed in claim 2, wherein the metal sleeve and the plastic collar each has a round inner section.

* * * * *